US008396238B2

(12) United States Patent
Ilic et al.

(10) Patent No.: US 8,396,238 B2
(45) Date of Patent: Mar. 12, 2013

(54) CABLE LENGTH ADJUSTMENT IN AUDITORY DEVICES

(75) Inventors: Slobodan Ilic, Lane Cove (AU); Phillip Stallard, Lane Cove (AU); Thomas Hunkeler, Lane Cove (AU); Olivier Blättler, Fribourg (AU)

(73) Assignee: Cochlear Limited, Macquarie University, NSW (AU)

( * ) Notice: Subject to any disclaimer, the term of this patent is extended or adjusted under 35 U.S.C. 154(b) by 586 days.

(21) Appl. No.: 12/437,052

(22) Filed: May 7, 2009

(65) Prior Publication Data

US 2010/0086161 A1 Apr. 8, 2010

(30) Foreign Application Priority Data

May 7, 2008 (AU) ..... 2008902232

(51) Int. Cl.
*H04R 25/02* (2006.01)

(52) U.S. Cl. ..... 381/322; 381/324; 381/328; 381/330; 381/380; 381/381; 381/382

(58) Field of Classification Search ..... 381/322, 381/323, 324, 328, 330, 380–382, 384
See application file for complete search history.

(56) References Cited

U.S. PATENT DOCUMENTS

| | | | | |
|---|---|---|---|---|
| 2,863,005 | A | 12/1958 | Knauert | |
| 4,170,372 | A * | 10/1979 | Salomon | 280/626 |
| 4,727,582 | A | 2/1988 | de Vries et al. | |
| 5,814,095 | A * | 9/1998 | Muller et al. | 607/57 |
| 6,748,094 | B1 | 6/2004 | Tziviskos et al. | |
| 7,020,298 | B1 | 3/2006 | Tziviskos et al. | |
| 7,110,562 | B1 | 9/2006 | Feeley et al. | |
| 7,142,926 | B2 | 11/2006 | Crawford | |
| 7,401,679 | B2 * | 7/2008 | Ipsen | 181/129 |
| 7,783,068 | B2 * | 8/2010 | Klemenz et al. | 381/328 |
| 2005/0006171 | A1 * | 1/2005 | Ipsen | 181/135 |
| 2006/0159298 | A1 | 7/2006 | von Dombrowski et al. | |
| 2006/0276856 | A1 * | 12/2006 | Soli et al. | 607/57 |
| 2007/0286442 | A1 * | 12/2007 | Hessel et al. | 381/322 |
| 2009/0041279 | A1 * | 2/2009 | Davis | 381/328 |
| 2009/0123010 | A1 * | 5/2009 | Cano et al. | 381/318 |
| 2011/0007919 | A1 * | 1/2011 | Aquilina et al. | 381/324 |
| 2011/0091060 | A1 * | 4/2011 | von Dombrowski et al. | 381/328 |

FOREIGN PATENT DOCUMENTS

| | | |
|---|---|---|
| DE | 27 21 469 | 11/1978 |
| DE | 20 2006 006851 | 7/2006 |
| WO | 2008/074898 | 6/2008 |

OTHER PUBLICATIONS

European Search Report for EP 09 00 6187 dated Aug. 11, 2009.

* cited by examiner

*Primary Examiner* — Allan R Wilson
(74) *Attorney, Agent, or Firm* — Kilpatrick, Townsend & Stockton, LLP.

(57) ABSTRACT

An In-The-Ear (ITE) device is disclosed. This ITE is adapted for connection to a cable from a Behind-The-Ear (BTE) device, the ITE device including a releasable mechanical retention device for the cable, such that the cable may be customized in length and may be attached to the retention device.

20 Claims, 5 Drawing Sheets

CABLE LENGTH ADJUSTMENT IN AUDITORY DEVICES

CROSS-REFERENCE TO RELATED APPLICATIONS

The present application claims the benefit of Australian Provisional Patent Application No. 2008902232, filed May 7, 2008, which is hereby incorporated by reference herein.

BACKGROUND

1. Field of the Invention

The present invention relates to auditory devices, and more particularly to cable length adjustments for auditory devices.

2. Related Art

A certain category of hearing aid users are best assisted using a combination of hardware components for the ear which is being treated. A sound processor device, typically including one or more microphones, is provided in a behind the ear (BTE) device. A receiver unit is then provided in the ear canal, either partially or totally in the canal, in order to provide amplified acoustic stimulation for the user. The receiver is conventionally connected to the BTE device using an electrical cable which passes over or under the ear and then into the receiver.

It has been recognized that, for some users, the combination of a cochlear implant with acoustic stimulation in the same ear has significant benefits. In some such arrangements, a BTE device is provided, which is electrically connected via a cable to the receiver in the ear canal. The BTE device provides sound processing and outputs an electrical signal to the receiver via the cable.

The term ITE device is intended to encompass a device which is configured to fit wholly or partially within a recipient's ear, such as wholly or partially within the recipient's ear canal, whether for a cochlear implant system, hearing aid, bone conduction device, or other hearing prosthesis.

An electro-acoustic system is commercially provided under the Duet brand by Advanced Bionics Corporation (ABC). In this device, the receiver is integrated into the BTE device. The acoustic connection between the BTE device and the ear canal is a sound pipe for channeling the acoustic signals—the acoustic signals are generated within the BTE device.

U.S. Pat. Nos. 6,748,094, 7,020,298 and 7,142,926, all assigned to ABC, describe the connection of the connection of the earhook to a BTE sound processor via different types of electro-mechanical connectors.

One issue with all such arrangements, in which a BTE device is electrically connected to a receiver in the ear, relates to the connecting cable. It is important to appreciate that the device is worn more or less constantly by the user and so issues such as comfort and cosmetic appeal are very important. The cable is the part of the system which is typically most vulnerable to damage. In many BTE hearing aid systems, an S shaped cable is used to provide some degree of adjustment and accommodation between the receiver and the BTE device. This allows for a small number of standard cable lengths, and earhook combinations, to be used for all users.

SUMMARY

In one aspect of the present invention, there is provided an In The Ear (ITE) device comprising: a retention device configured to adjust the length of a cable connecting the ITE with a Behind The Ear (BTE) device; and wherein the ITE is configured to fit at least partially within a recipient's ear and is configured to provide stimulation regarding sound to the recipient.

In a second aspect of the present invention, there is provided a hearing prosthesis assembly, comprising: a Behind The Ear (BTE) device, an In The Ear (ITE) device; and a cable configured to connect the BTE and the ITE; and wherein the ITE device comprises: a retention device configured to adjust the length of the cable connecting the ITE and the BTE device.

In a third aspect of the present invention, there is provided a method of fitting a hearing prosthesis, the method comprising: providing a Behind the Ear (BTE) device, a face plate unit comprising a retention device, and a cable attached to the BTE device; forming an earshell specifically adapted to a recipients ear; fitting the earshell to the face plate to form an In the Ear (ITE) device; fitting the BTE device and ITE device on the recipient; adjusting a length of the cable with the BTE device and ITE device fitted on the recipient; and mechanically securing the cable in position using a retention device included in the ITE device.

BRIEF DESCRIPTION OF THE DRAWINGS

Illustrative embodiments of the present invention will now be described with reference to the accompanying figures, in which.

DETAILED DESCRIPTION

An embodiment of the present invention will be described below with reference to an illustrative example of a device intended for use in a hybrid electrical and acoustic stimulation system. However, it will be appreciated that the present invention is applicable wherever a cable is used to connect a BTE device to an ITE device. It may be applied to a cochlear implant system such as a hybrid electrical/acoustic system, a hearing aid system, a bone conduction device, or any other suitable hearing prosthesis. It may be applied to a system with implanted components, or a fully external system. The ITE device may be acoustic only, or may include other functions, for example electrical or communications components. Or, the ITE device may provide mechanical stimulation, such as for example, in accordance with a bone conduction device. One such type of bone conduction device is described in U.S. patent application Ser. No. 12/373,887 filed Jan. 14, 2009 by Manohar Bance and entitled "Hearing Device Having a Non-Occluding In the Canal Vibrating Component," which is incorporated by reference herein. It will be appreciated that the present implementation is described for illustrative purposes, and its features are not intended to be limitative of the scope of the present invention. Many variations and additions are possible within the scope of the present invention.

Receiver in the ear (RITE) units are one type of ITE device presently being manufactured for hearing aid and hybrid system use. Presently, for an RITE manufacturer to build a perfectly fitting RITE using conventional techniques, the ear imprint maker must provide the RITE manufacturer with an accurate indication of the desired cable length, a good estimation of the future level of the face plate, and a correct indication of the cable entry point and entry angle. The RITE manufacturer then must accurately implement this information in his digital 3D RITE design file. Any changes or variations or production errors or if the recipient changes their mind may require the entire process to be re-started.

Figure 1:
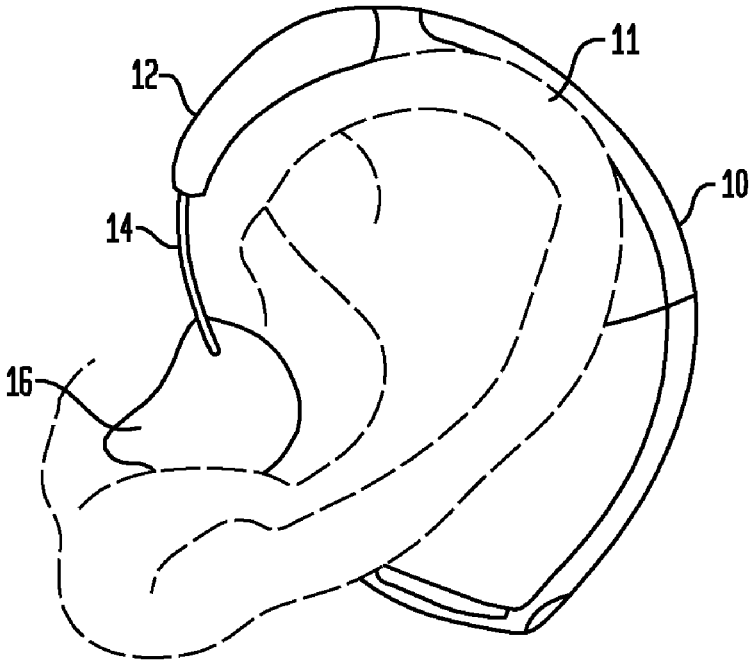
FIG. 1 (PRIOR ART)
FIG. 1 illustrates a fitted prior art BTE and receiver combination.

FIG. 1 illustrates a fitted prior art BTE and receiver combination. As illustrated, a BTE device 10 rests behind the pinna 11, with the earhook 12 of BTE 10 extending over the top of pinna 11. A cable 14 extends from BTE device 10, directly into the ITE device 16. There are considerable differences between people in the detailed anatomy of their outer ear and pinna 11. For example, the shape and angle of the ear canal (not shown) may vary widely, as do the relative angles of the canal (not shown) and the pinna 11. Similarly, there may be large variations in the shape, angle and dimensions of the pinna 11 amongst different potential recipients. As such, there is not a single cable length that all potential recipients can use. Moreover, using a small set of standard cable sizes, or changeable earhook/cable combinations, may result in significant mismatches between the required cable length and the available lengths for some users.

Figure 2:
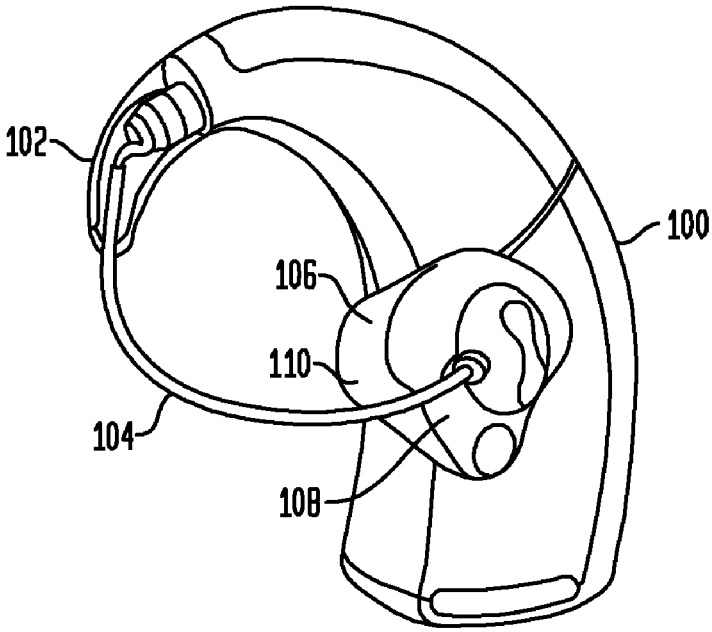
FIG. 2 is a schematic view of an assembled device, in accordance with an embodiment of the present invention.

An illustrative embodiment will be described with reference to the general arrangement shown in FIG. 2. As illustrated in FIG. 2, BTE device 100 is attached to earhook 102, and cable 104 extends from the earhook to ITE 106. Earhook 102 may be, for example, integral with BTE 100 or changeable. BTE device 100 may include a battery pack (not shown), microphones (not shown), and processing means (not shown) as required. The specific electrical functionality of BTE 100 device is not important to the present invention and will not be further discussed. It is noted that ITE device 106 may include a receiver (not shown), the driving electrical signals for which are provided by the BTE device.

Although in the present embodiment the combination of earhook 102 and ITE 106 are described as a permanent assembly, in alternative embodiments an electrical connector could be provided on a face plate of ITE 106 for de-coupling the earhook 102 and ITE 106. Such an electrical connector may help provide enhanced servicing flexibility.

BTE 100 and ITE 106 may be, for example, an SP12 BTE SP (Sound Processor) and an acoustic ITE unit, respectively, commercially available from Cochlear Ltd. As noted above, in such embodiments, ITE 106 is connected to BTE device 100 via an electrical cable 104 running through earhook 102.

Correctly selecting the length of cable 104 is important for several reasons. First, a neat cable is visually discreet and more aesthetically pleasing. One of the major reasons for rejection of hearing aids, and especially BTE devices, is a lack of cosmetic acceptability. When a cable is correctly fitted in accordance with an embodiment of the present invention, the combined assembly has a more homogenous appearance, and blends into the shape of the pinna in a less visible way.

A second issue with BTE devices is that in some cases they can be quite heavy, and hence uncomfortable for the user. A cable with an incorrect length or orientation can exacerbate this, by introducing tensions between the BTE and the ITE. It is also helpful if the cable has the correct stiffness characteristics to avoid this outcome. For example, a stiff or semi-stiff cable can provide significant benefit in keeping the BTE in place and reducing the pressure on the pinna, but only when it is very closely matched to the correct length and rotation. Any mismatch in length or rotation may create difficulties. However, a particularly advantage of a cable of correct length and placement is that via the cable, the ITE can bear part of the weight of the BTE device and assist in retention of the assembly as a whole.

An ITE according to the presently discussed exemplary embodiment may be assembled from two main elements: a made-to-measure plastic part (referred to herein as the earshell 110) designed to fit exactly or nearly exactly in the ear canal of the individual recipient, and a standard front part (the face plate 108). During the ITE production process face plate 108 may be permanently glued to earshell 110 and then manually finished to its final contour.

In an embodiment, earshell 110 is custom manufactured from a mold of the user's ear. This process may be the same as that used to form a conventional ITE device, and will accordingly not be described in detail herein. An earshell 110 produced in this manner preferably has an exposed surface suitable for connection to the ITE's face plate 108.

As illustrated, electrical cable 104 enters ITE 106 via face plate 108 and is connected to a small speaker (not shown). This small speaker is also referred to herein as the ITE's receiver). In an embodiment, the receiver is a pre-assembled unit. ITE face plate 108 may include a system allowing adjustment of the length of cable 104 and allowing cable 104 to be locked into the correct position.

Figure 3:
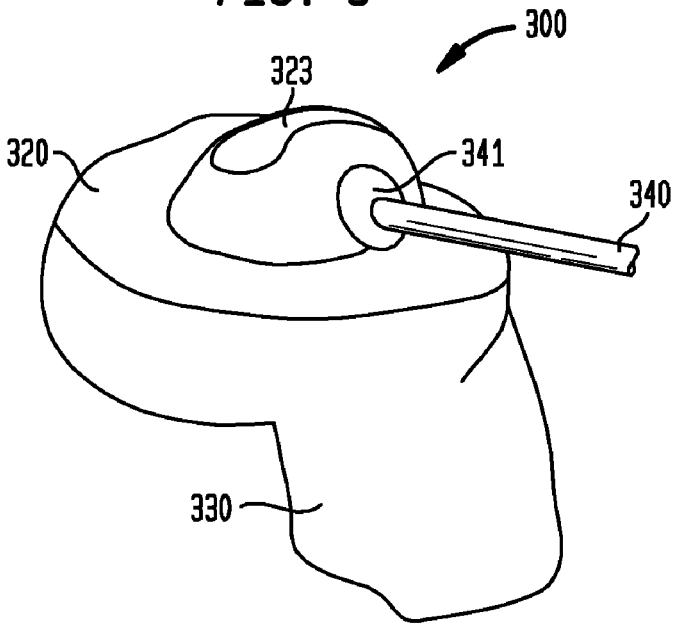
FIG. 3 is a view of a face plate assembly, in accordance with an embodiment of the present invention.
Figure 4A:
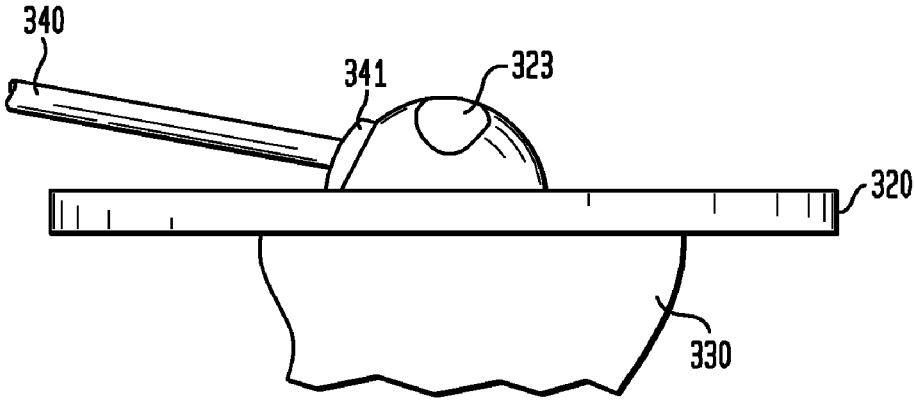
FIG. 4A is a side view of a face plate assembly attached to an earshell but prior to finishing of the face plate, in accordance with an embodiment of the present invention.

FIG. 3 illustrates an assembled ITE device 106, referred to as ITE device 310, in accordance with an embodiment of the present invention. As illustrated, ITE device 310 includes a face plate 320 and an earshell 330 affixed thereto. Further, a cable 340 extends from face plate 320 of ITE device 300. FIG. 4A is a view ITE device 300 during manufacture of ITE device 310. As illustrated in FIG. 4A, face plate 320 may be affixed to earshell 330 such that face plate 320 initially extends beyond the perimeter of earshell 330. Face plate 320 may be affixed to earshell 330 using an adhesive or the like. Then, face plate 320 may be cut to its final contour and rounded off and finished to match the shape of earshell 330.

Figure 4B:
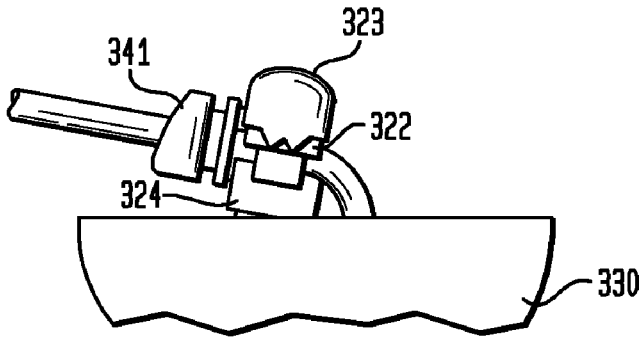
FIG. 4B is a partly internal view of a face plate assembly, in accordance with an embodiment of the present invention.
Figure 5:
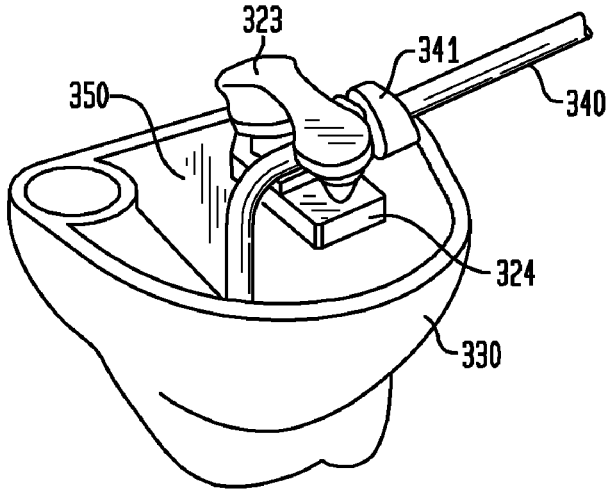
FIG. 5 is a view showing the internal components of the face plate assembly positioned on the ear shell in accordance with an embodiment of the present invention.
Figure 6:
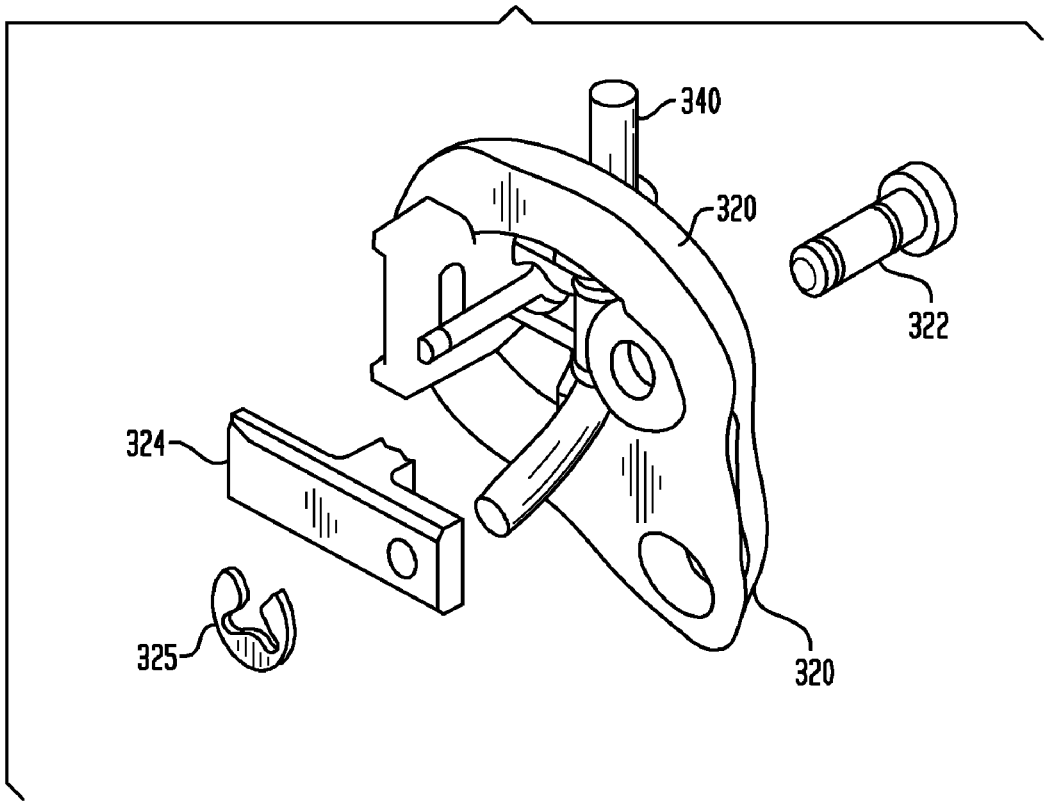
FIG. 6 is a detailed view of the face plate and clamp mechanism in accordance with an embodiment of the present invention.

FIG. 4B illustrates a partly internal view of ITE device 300 after attachment of face plate 320 to earshell 330. It should be noted that the cover of face plate 320 not illustrated in FIG. 4B to assist in explanation of the arrangement of the internal components of ITE device 300. FIG. 5 illustrates another view of the internal components of face plate 320 positioned on earshell 330. For ease of explanation, the face plate cover is removed in FIG. 5. FIG. 6 illustrates yet another view of the face plate components.

As illustrated, a cable adjustment and fixation system (also referred to herein as a retention device) may be located in ITE faceplate 320. Cable 340 passes through a grommet 341 and into ITE device 310.

As illustrated in FIG. 5, earshell 330 may include a space 350 for storing excess cable after adjustment of the length of cable 340. In an embodiment, cable 340 is soldered to the receiver (not shown) in the ITE device 300. Cable 340 in an embodiment has sufficient length to allow it to be positioned without tensioning the soldering contacts between cable 340 and the receiver (not shown).

Cable 340 may also be connected to the receiver in the ITE device 310 by a releasable connector. Similarly, a releasable connector can also be used for connecting the cable with the BTE device.

As illustrated, cable 340 enters face plate 320 via a rubber grommet 341 for sealing purposes and for protecting cable 340 against internal breakage due to being bent too sharply or similar hazards. Cable 340 then passes over a clamp 324 that will ultimately lock it in place by clamping it against the internal surface of face plate 320. Clamp 324, in its open position, allows cable 340 to move freely during the adjustment process, and when clamp 324 is tensioned by screw 322 it locks cable 340 into position. A flexible cover 323 may be used to finish and seal the screw opening in face plate 320.

It will be appreciated that there are many suitable alternative structures which could provide the necessary mechanical retention, and the locking system can be designed in using many variations on the described mechanical design. Such variations can be, for example, with or without a locking screw. The locking system could also allow only one-way cable adjustability freedom, such as, for example, only allowing lengthening of the cable (or only shortening of the cable) during the fitting process before locking the cable. In another embodiment, the cable fixation system can be simplified to a more basic solution of entering the ITE device through an opening, such as the grommet, and fixing it with a sealant. This solution is simple, small and strong. Furthermore it seals the cable to the grommet in a hygienic and watertight way.

Figure 7:
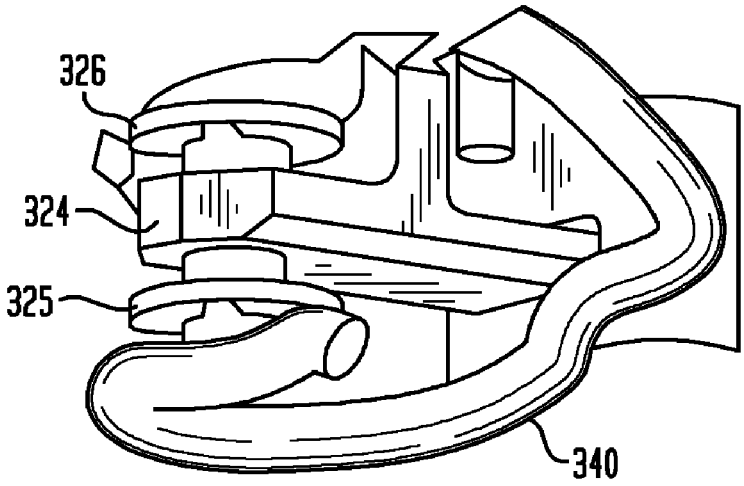
FIG. 7 is a view illustrating the operation of an alternative structure for the clamp, in accordance with an embodiment of the present invention.

ITE device 300 may use a circlip 325 on the edge of the screw to help prevent against accidental removal of screw 322 and/or loosening of screw 322 that may result in losing the correct position of the clamp. FIG. 7 illustrates an alternative clamping system comprising a clamp 324, a circlip 325, and a second circlip 326. The second circlip 325 may help prevent damage to cable 340 due to overstressing cable 340.

Figure 8:
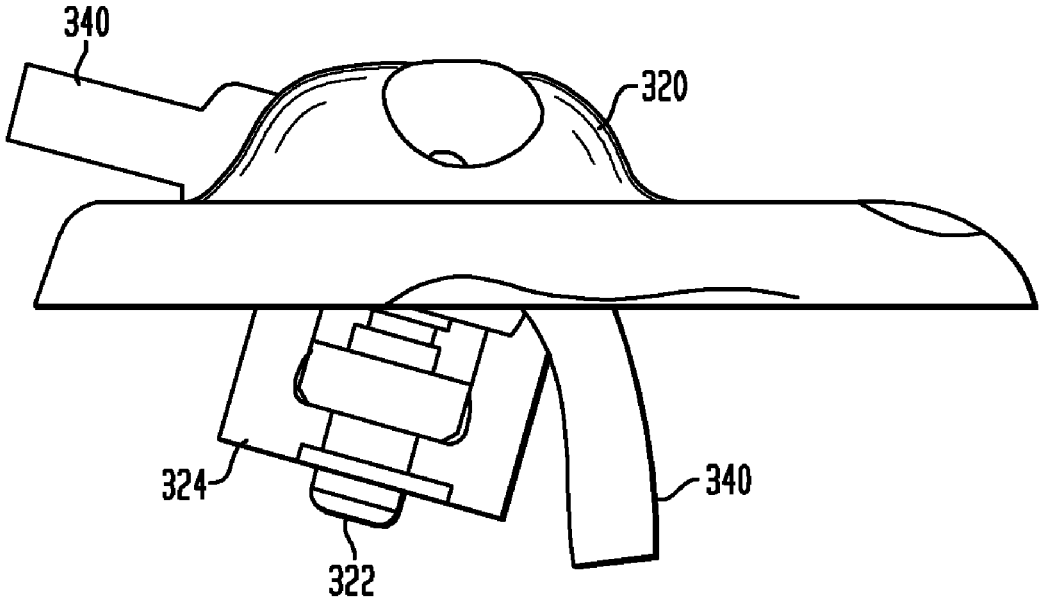
FIG. 8 is a detailed side view of an assembly corresponding to FIG. 6 in accordance with an embodiment of the present invention.
Figure 9A:
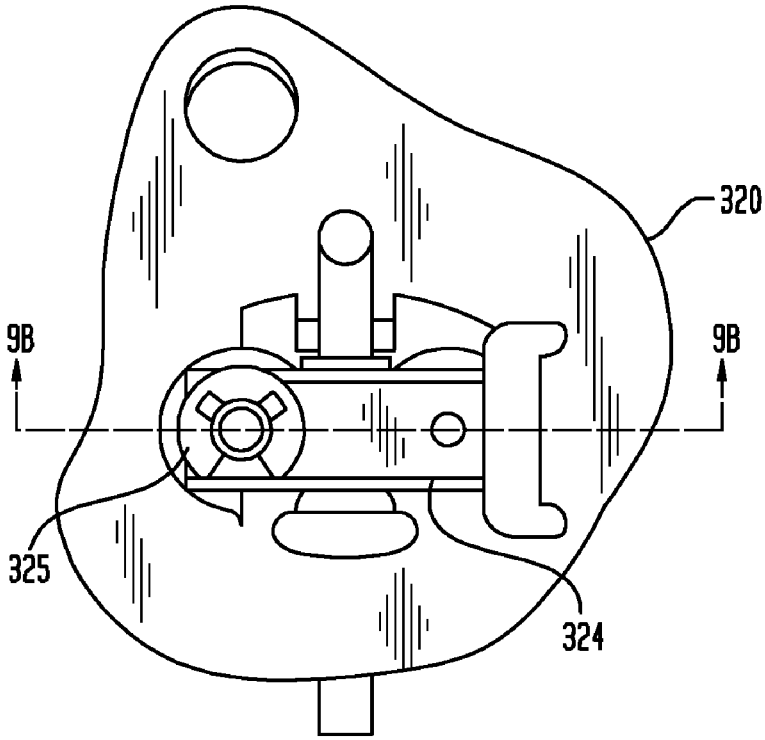
FIGS. 9A and 9B show an assembled bottom view and a sectional view along line B-B of the assembly of FIG. 8, in accordance with an embodiment of the present invention.
Figure 9B:
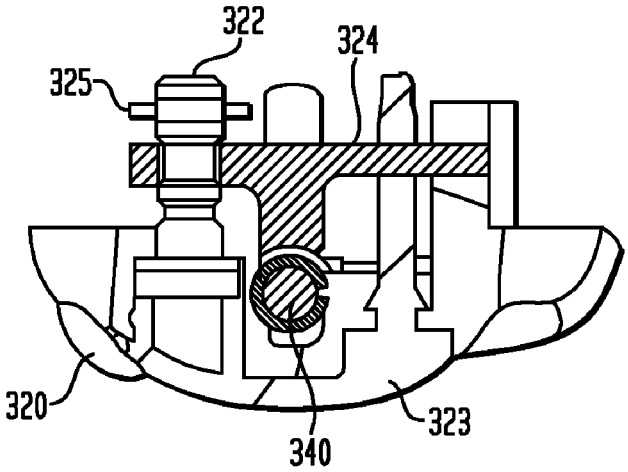

FIGS. 8, 9A and 9B illustrate in more detail the construction of the exemplary implementation of the above-discussed embodiment. As shown, the operation and exemplary arrangement of the assembly including the screw 322, face plate 320, clamp 324 and circlip 325 can be more readily understood from these drawings.

Faceplate 320, cable 340 and the cable adjustment components (e.g., screw 322, clamp 324, etc.) may be pre-assembled with electric cable 340 and connected to earhook 302 via an integrated connector.

The above-discussed embodiment provides flexibility during the initial fitting on the recipient's ear. The recipient can experience the comfort of the assembly prosthesis, and can provide real-time feedback for cable length corrections to be made by the audiologist during the fitting session. This helps to obtain the optimal length and orientation.

The embodiment described is meant to be used for adjustment by the audiologist at the time of fitting, after which it is fixed into position. However, later adjustments may be required, and an implementation to more readily facilitate this may be foreseen. Similarly, whilst this adjustment is preferably made by the audiologist, some adjustment accessible by the user could be provided.

In one alternative implementation, the face plate can have a sufficiently small contour to be integrated in the front side of the custom earshell without having to be finished manually, or with minimal finishing. This may help reduce the ITE production effort and allow for easier and faster servicing.

As another alternative, the face plate could be designed such that it can be rotated around its axis for extra fitting freedom for the audiologist during the fitting session. When fixing the cable in its final position, this rotation would also be fixed.

As another alternative, the face plate could be designed such that it is snapped into the ITE earshell and can later be removed, possibly by using a specific tool. This may allow simplified and more standardized production, cleaning comfort for the recipient and dramatically facilitated servicing even including electronics replacements by the recipient.

The receiver component can be integrated in a sub-housing that is in its own turn integrated into the customized earshell. The integration of the receiver in its own housing provides a customized end result starting from a maximally standardized technical functional unit that can be entirely produced in series and tested. This concept is being used by several hearing aid companies.

The illustrative process above describes the earhook plus cable plus ITE face plate plus receiver as a pre-assembled unit to be integrated in the customized ITE. However, solutions can be such that the cable is to be cut and stripped to length during the ITE manufacturing process. This adds the possibility to remove and replace the combined cable and earhook in case of electrical problems. A removable cable may require opening the ITE and soldering the receiver at the ITE manufacturing plant.

The grommet at the cable entry point on the ITE can be configured such that it provides more protection against sharp bends, or even includes a small finger grip for easy removal of the ITE from the ear.

Providing an ITE that permits cable length adjustments can help improve the ergonomic fit of the BTE device and the ITE can be optimized for each individual recipient during the fitting of the device until the recipient is fully satisfied. As noted above, embodiments of the present invention allow the cable to be tuned to the correct length and rotation, thereby avoiding tensions between the components and allowing the cable to have a beneficial impact on recipient comfort and BTE retention. Further, the ear imprint making and the ITE device production processes may be simplified, and the risk for errors in the integration of the cable into the custom molding reduced.

It is to be understood that the detailed description and specific examples, while indicating embodiments of the present invention, are given by way of illustration and not limitation. Many changes and modifications within the scope of the present invention may be made without departing from the spirit thereof, and the invention includes all such modifications.

What is claimed is:

1. An apparatus, comprising:

an In The Ear (ITE) device including:

a retention device configured to adjust the length of a cable connecting the ITE device with a Behind The Ear (BTE) device;

wherein the ITE device is configured to fit at least partially within a recipient's ear and is configured to provide stimulation regarding sound to the recipient, and wherein the ITE device further comprises:

a face plate; and an earshell specifically formed for the recipient; and wherein the retention device is integrated in the face plate.

2. The apparatus of claim 1, wherein the retention device is configured to releasably restrain the cable such that when released a length of the cable may be adjusted.

3. The apparatus of claim 1, wherein the retention device comprises:

a clamp configured to releasably restrain the cable.

4. The apparatus of claim 1, wherein the face plate is configured to be rotated relative to an axis of the earshell and wherein the rotation of the face plate can be fixed.

5. The apparatus of claim 1, wherein the face plate is configured to releasably snap into the earshell.

6. The apparatus of claim 1, wherein the earshell comprises a space for storing excess cable after length adjustment.

7. The apparatus of claim 1, wherein retention device comprises:

a clamp configured to releasably restrain the cable;

a screw for fixing the clamp at the face plate; and a circlip configured to fit on the screw.

8. The apparatus of claim 1, wherein the ITE device further comprises:

a releasable connector for electrically connecting the cable with the ITE device.

9. The apparatus of claim 1, wherein the ITE is configured to fit at least partially within an ear canal of the recipient.

10. The apparatus of claim 1, wherein the ITE is configured to provide mechanical stimulation to the recipient.

11. A hearing prosthesis assembly, comprising:

a Behind The Ear (BTE) device, an In The Ear (ITE) device; and a cable configured to connect the BTE device and the ITE device; and wherein the ITE device comprises:

a retention device configured to adjust the length of the cable connecting the ITE device and the BTE device;

a face plate; and an earshell specifically formed for the recipient; and wherein the retention device is integrated in the face plate.

12. The hearing prosthesis of claim 11, wherein the BTE device comprises an earhook and wherein the cable extends from the earhook to the ITE device such that the ITE device and the cable assist in supporting the BTE device when the hearing prosthesis is fitted to a recipient.

13. The hearing prosthesis of claim 11, wherein the ITE device comprises at least a portion which is custom fitted for a recipient such that the ITE device is configured to fit at least partially within a recipient's ear canal.

14. A method of fitting a hearing prosthesis, the method comprising:

providing a Behind the Ear (BTE) device, a face plate unit comprising a retention device, and a cable attached to the BTE device;

forming an earshell adapted to a recipient's ear;

fitting the earshell to the face plate to form an In the Ear (ITE) device;

fitting the BTE device and ITE device on the recipient;

adjusting a length of the cable with the BTE device and ITE device fitted on the recipient; and securing the cable in position using a retention device included in the ITE device.

15. The method of claim 14, further comprising:

obtaining a mold of at least a portion of an ear of the recipient; and wherein forming an earshell comprises:

forming the earshell using the mold.

16. The method of claim 14, wherein the retention device comprises a screw and a clamp, and wherein adjusting a length of the cable comprises:

loosening a screw included in a face plate of the ITE device; and pushing at least a portion of the cable into the ITE device to shorten the length of the cable; and wherein securing the cable comprises:

tightening the screw.

17. The method of claim 16, further comprising:

attaching a second circlip to the screw.

18. The method of claim 14, further comprising:

rotating the face plate relative to an axis of the earshell; and fixing the rotation of the face plate.

19. An apparatus, comprising:

an In The Ear (ITE) device comprising:

a retention device configured to adjust the length of a cable connecting the ITE device with a Behind The Ear (BTE) device;

a face plate integrated with the releasable mechanical retention device; and an earshell configured to be coupled to the face plate, wherein the releasable mechanical retention device is configured to allow the cable to move through the face plate and into the ITE device to enable adjustment of the length of the cable and configured to lock the cable into position; and an earshell configured to be coupled to the face plate, wherein the ITE device is configured to fit at least partially within a recipient's ear and is configured to provide stimulation regarding sound to the recipient.

20. A hearing prosthesis assembly, comprising:

a Behind The Ear (BTE) device;

an In The Ear (ITE) device; and a cable configured to connect the BTE device and the ITE device; and wherein the ITE device comprises:

a retention device configured to adjust the length of the cable connecting the ITE device and the BTE device;

a face plate integrated with the releasable mechanical retention device; and an earshell configured to be coupled to the face plate, wherein the releasable mechanical retention device is configured to allow the cable to move through the face plate and into the ITE device to enable adjustment of the length of the cable and configured to lock the cable into position.

* * * * *